US006773659B2

(12) United States Patent
Dunne et al.

(10) Patent No.: US 6,773,659 B2
(45) Date of Patent: Aug. 10, 2004

(54) GAS INJECTION LANCE

(75) Inventors: Martin Joseph Dunne, West Midland, WA (US); Gregory John Hardie, Windermere (AU)

(73) Assignee: Technological Resources Pty Ltd., Melbourne (AU)

( * ) Notice: Subject to any disclaimer, the term of this patent is extended or adjusted under 35 U.S.C. 154(b) by 139 days.

(21) Appl. No.: 10/190,595

(22) Filed: Jul. 9, 2002

(65) Prior Publication Data

US 2003/0011114 A1 Jan. 16, 2003

(30) Foreign Application Priority Data

Jul. 10, 2001 (AU) ..... PR6248

(51) Int. Cl.[7] ..... C21C 5/32
(52) U.S. Cl. ..... 266/225; 266/46
(58) Field of Search ..... 266/225, 270, 266/46, 268

(56) References Cited

U.S. PATENT DOCUMENTS 4,783,060 A 11/1988 Struzik et al.
4,951,928 A 8/1990 Eysn et al.
6,440,356 B2 * 8/2002 Dunne ..... 266/225
6,478,848 B1 * 11/2002 McCarthy et al. ..... 75/414
6,673,305 B2 * 1/2004 Dunne et al. ..... 266/225

FOREIGN PATENT DOCUMENTS

GB 1484745 A 9/1977
WO WO 9702365 A1 1/1997

* cited by examiner

*Primary Examiner*—Scott Kastler
(74) *Attorney, Agent, or Firm*—Miles & Stockbridge P.C.; John C. Kerins

(57) ABSTRACT

A gas injection lance and an apparatus employing the lance for producing ferrous metal are provided. The lance has an elongated flow duct made of inner and outer concentric carbon steel tubes, a cooling water supply and return, and exterior surface which is designed to hold a frozen layer of slag on the duct, a gas inlet at a rear end of the duct, a tip joining the concentric tubes at the forward end of the duct, a non-metallic or refractory lining for the duct, and swirl-imparting member or members located in the duct for imparting swirl in the gas flow through the forward end of the duct.

35 Claims, 9 Drawing Sheets

11
17
18
26
D
15
151
27
27
14
16
153
21
13
12
82
82
23
24
25
22
19

GAS INJECTION LANCE

BACKGROUND OF THE INVENTION

1. Field of the Invention

The present invention provides a lance for injecting preheated gas into a vessel.

The invention has particular, but not exclusive, application to a lance for injecting a flow of preheated gas into a metallurgical vessel under high temperature conditions.

The metallurgical vessel may for example be a direct smelting vessel in which molten metal is produced by a direct smelting process.

The present invention also provides a direct smelting apparatus which includes a lance for injecting gas into a direct smelting vessel.

2. Description of Related Art

In general, molten bath-based processes for direct smelting ferrous material into molten iron that are described in the prior art require post-combustion of reaction products such as CO and $H_2$ released from a molten bath in order to generate sufficient heat to maintain the temperature of the molten bath.

The prior art generally proposes that post combustion be achieved by injecting oxygen-containing gas via lances that extend into a top space of a direct smelting vessel.

For economic reasons, it is desirable that direct smelting campaigns be relatively long, typically at least one year, and therefore it is important that gas injection lances be capable of withstanding the high temperature environment, typically of the order of 2000° C., within the top space of a direct smelting vessel for the prolonged periods of campaigns.

One option for providing oxygen-containing gas is to use air or oxygen-enriched air that is preheated to above 800° C.

Stoves or pebble heaters are the only currently viable options for pre-heating air or oxygen-enriched air. One consequence of the use of stoves and pebble heaters is that the air or oxygen-enriched air will pick up hard particulate material as it passes through the stoves and pebble heaters and this material can cause considerable wear to the internal surface of a lance.

The use of air or oxygen-enriched air also means that considerably larger volumes of gas are required to achieve a given level of post combustion than would be required if oxygen was used as the oxygen-containing gas. Consequently, a direct smelting vessel operating with air or oxygen-enriched air must be a considerably larger structure than a direct smelting vessel operating with oxygen.

Consequently, a lance for injecting air or oxygen-enriched air into a direct smelting vessel must be a relatively large structure that can extend a relatively substantial distance into a direct smelting vessel and be unsupported over at least a major part of the length of the lance. By way of context, 6 meter diameter HIsmelt vessels proposed by the applicant include lances having an outer diameter of 1.2 m that are of the order of 60 tonnes and extend approximately 10 m into the vessel.

In addition, such a lance must be capable of delivering relatively large volume flow rates of pre-heated air or oxygen-enriched air and withstanding wear of the interior of the lance due to erosive particulate material in the air or oxygen-enriched air over prolonged smelting campaigns.

For economic and structural reasons, carbon steel is the preferred material for constructing a lance for injecting pre-heated air or oxygen-enriched air.

However, carbon steel is not a preferred material in terms of resisting wear of the interior of the lance and particularly in light of the risk of rapid oxidation (ie ignition) of steel under hot injection conditions.

It is evident from the above that the use of pre-heated air or oxygen-enriched air presents significant issues in terms of the construction of lances for injecting the air or oxygen-enriched air into direct smelting vessels over prolonged smelting campaigns.

An object of the present invention is to provide a water cooled lance that may be constructed using carbon steel as a major structural component of the lance and is capable of injecting pre-heated air or oxygen-enriched air into a direct smelting vessel during a lengthy operating campaign.

SUMMARY OF THE INVENTION

According to the present invention there is provided a lance for injecting a pre-heated oxygen-containing gas into a vessel containing a bath of molten material, the lance including:

(a) an elongate gas flow duct extending from a rear to a forward end of the duct from which to discharge gas from the duct, the duct including; (i) inner and outer concentric carbon steel tubes which provide major structural support for the duct, (ii) cooling water supply and return passage means extending through the duct wall from the rear end to the forward end of the duct for supply and return of cooling water to the forward end of the duct, (iii) an exterior surface that includes a mechanical means adapted to hold a layer of frozen slag on the duct;

(b) a gas inlet for introducing hot gas into the rear end of the duct;

(c) tip means joined to the concentric tubes at the forward end of the duct, (d) a protective lining formed from a refractory or other material that is capable of protecting the duct from exposure to gas flow at 800–1400° C. through the duct, the lining being a non-metallic material with heat insulating properties when compared to the steel tubes; and (e) a means located in the duct for imparting swirl to gas flow through the forward end of the duct.

Preferably the duct includes three or more concentric steel tubes extending to the forward end of the duct.

Preferably the gas inlet includes a refractory body defining a first tubular gas passage aligned with and extending directly to the rear end of the duct and a second tubular gas passage transverse to the first passage to receive hot gas and direct it to the first passage so that the hot gas and any particles entrained therein impinge on the refractory wall of the first passage, with the gas flow undergoing a change of direction in passing from the second passage to the first passage.

Preferably the mechanical means on the exterior surface of the duct includes projections that are shaped to interlock with and hold frozen slag on the duct.

Preferably the projections are lands with each land having an undercut or dovetail cross-section so that the lands are of outwardly diverging formation and serve as keying formations for solidification of slag.

Preferably the tip means is of hollow annular construction and is formed from a copper-containing material.

Preferably the forward end of the duct is formed as a hollow annular tip formation and the duct includes duct tip cooling water supply and return passages for supply of cooling water forwardly along the duct into the tip means and return of that cooling water back along the duct.

Preferably the lance includes an elongate body disposed centrally within the forward end of the duct such that gas flowing through the forward end of the duct flows over and along the elongate central body.

Preferably a forward end of the elongate body and the tip means co-act together and form an annular nozzle for flow of gas from the duct with swirl imparted by the swirl means.

Preferably the swirl means includes a plurality of flow directing vanes connected to the elongate body to impart swirl to gas flow through the forward end of the duct.

In one embodiment of the present invention the elongate body is an elongate central tubular structure extending within the gas flow duct from its rear end to its forward end and the vanes are disposed about the central tubular structure adjacent the forward end of the duct to impart swirl to the gas flow to the forward end of the duct.

Preferably the central tubular structure includes a water cooling passage for flow of cooling water forwardly to its forward end.

More preferably the central tubular structure includes cooling water passages for flow of cooling water forwardly through the central structure from its rear end to its forward end and to internally cool the forward end and thence to return back through the central structure to its rear end.

Preferably the central tubular structure defines a central water flow passage for flow of water forwardly through that structure directly to the forward end of the central structure and an annular water flow passage disposed about the central passage for return flow of water from the forward end of the central structure back to the rear end of that structure.

The central tubular structure may include a central tube providing the central water flow passage and a further tube disposed around the central tube to define said annular water flow passage between the tubes.

Preferably the central tubular structure includes a heat insulating outer shield to retard heat transfer from gas in the gas flow duct into the cooling water passages in the central structure.

The heat insulating shield may include a plurality of tubular segments of heat insulating material disposed end to end to form the heat shield as a substantially continuous tube extending from the rear end to the forward end of the central structure about an annular air gap disposed immediately within the heat shield.

The air gap may be formed between the tubular heat shield and the further tube defining the outer wall of the annular water return flow passage.

Preferably the tubular segments of the heat shield are supported to accommodate longitudinal expansion of each segment independently of the other such segments.

The forward end of the central tubular structure may include a domed nose portion provided internally with a single spiral cooling water passage to receive water from the central water flow passage in the central tubular structure at the tip of the nose and direct that water in a single flow around and backwardly along the nose to cool the nose with a single coherent stream of cooling water.

The central tubular structure may extend centrally through the first gas flow passage of the gas inlet means and rearwardly beyond the gas inlet. The rear end of the central structure may then be located rearwardly of the gas inlet and be provided with water couplings for the flow of cooling water to and from the central tubular structure.

In another, although not the only other, embodiment of the present invention the flow directing vanes are disposed between the elongate central body and the duct to impart swirl to gas flow through the forward end of the duct.

With this embodiment preferably the lance includes:

(a) internal cooling water passage means within the tip means communicating with the cooling water supply and return passage means of the duct so as to receive and return a flow of cooling water to internally cool the duct tip; and (b) cooling water flow passages within the vanes and the elongate central body and communicating with the cooling water supply and return passage means in the forward end of the duct for flow of water from the supply passage means inwardly through the vanes into the cooling passages of the elongate central body and from those passages outwardly through the vanes to the water return passage means of the duct.

Preferably the cooling water supply and return passage means of the duct include first supply and return passages communicating with the internal cooling water passage means in the tip means and second supply and return passages communicating with the water flow passages in the vanes and the central body.

The tip of the duct may be formed as a hollow annular formation with the hollow formation defining an annular passage constituting the internal cooling water passage means of the tip means.

The carbon steel concentric tubes of the duct may define a series of annular spaces providing the water flow supply and return passage means.

The elongate central body may be generally of cylindrical formation with domed ends.

Preferably the vanes are shaped to a multi-start helical formation. The vanes may then be connected to the duct at multiple locations spaced circumferentially around the duct. Specifically, there may be four vanes arranged in a four start helical formation and connected to the duct at four locations spaced at 90 degree intervals around the duct at the forward ends of the vanes.

The cooling water supply and return passage means of the duct may then include an appropriate number of separated water flow passages each to supply cooling water to one of the vanes. Such separated water flow passages may be formed by dividers within an appropriate annular passage between tubes of the duct extending helically along the duct.

The forward ends of the concentric carbon steel tubes may be connected at their forward ends to the tip means. The rear ends of the tubes may be mounted to allow relative longitudinal movement between them so as to accommodate differential thermal expansion and contraction of the tubes.

The vanes may be connected to the duct and to the central body at their forward ends only so as to be free to move along the duct from those connections under thermal expansion.

The invention also provides an apparatus for producing ferrous metal from a ferrous feed material by a direct smelting process, which apparatus includes a vessel that can contain a bath of molten metal and molten slag and a gas continuous space above the molten bath, which vessel includes:

(a) a hearth formed of refractory material having a base and sides;

(b) side walls extending upwardly from the sides of the hearth, the side walls including water cooled panels;

(c) a means for supplying ferrous feed material and carbonaceous material into the vessel;

(d) a means for generating a gas flow in the molten bath which carries molten material upwardly above a nominal quiescent surface of the molten bath and forms a raised bath;

(e) at least one gas injection lance as described in the preceding paragraphs extending downwardly into the vessel for injecting oxygen-containing gas into the vessel at an angle of 20 to 90° relative to a horizontal axis at a velocity of 200–600 m/s and at a temperature of 800–1400° C., the lance being located so that:
  (i) the lance extends into the vessel a distance that is at least the outer diameter of the forward end of the lance; and
  (ii) the forward end of the lance is at least 3 times the outer diameter of the forward end of the lance above a quiescent surface of the molten bath; and (f) a means for tapping molten metal and slag from the vessel.

Preferably the ferrous feed material and carbonaceous material supply means and the gas flow generating means includes a plurality of lances/tuyeres for injecting ferrous feed material and carbonaceous material with a carrier gas into the molten bath and generating the gas flow.

BRIEF DESCRIPTION OF THE DRAWINGS

The invention is more fully explained with reference to the accompanying drawings of which.

DETAILED DESCRIPTION OF THE PREFERRED EMBODIMENTS

The following description is in the context of smelting iron ore to produce molten iron and it is understood that the present invention is not limited to this application and is applicable to any suitable ferrous ores and/or concentrates—including partially reduced ferrous ores and waste revert materials.

Figure 1:
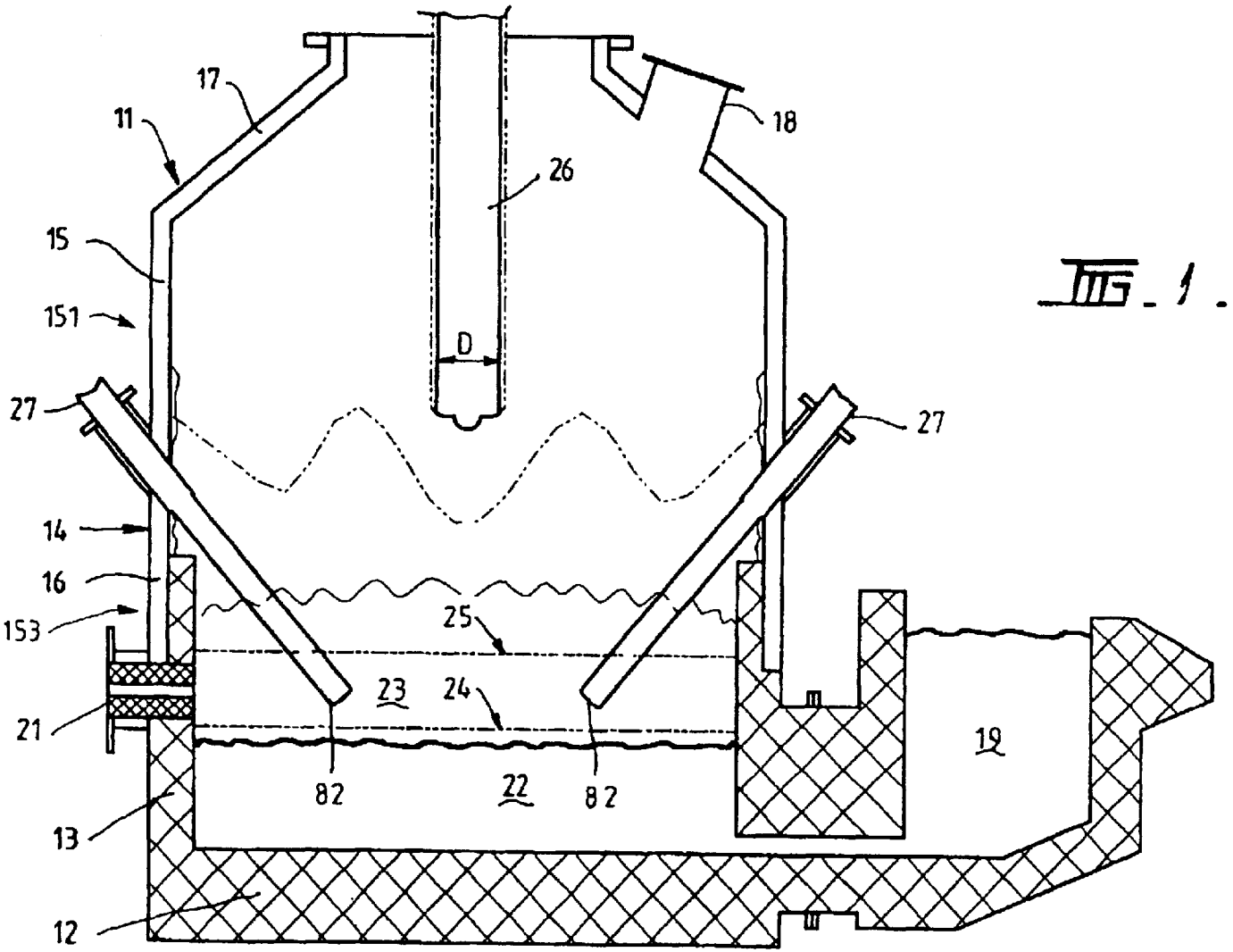
FIG. 1 is a vertical section through a direct smelting vessel incorporating a pair of solids injection lances and a hot air blast injection lance constructed in accordance with the invention.
Figure 2:
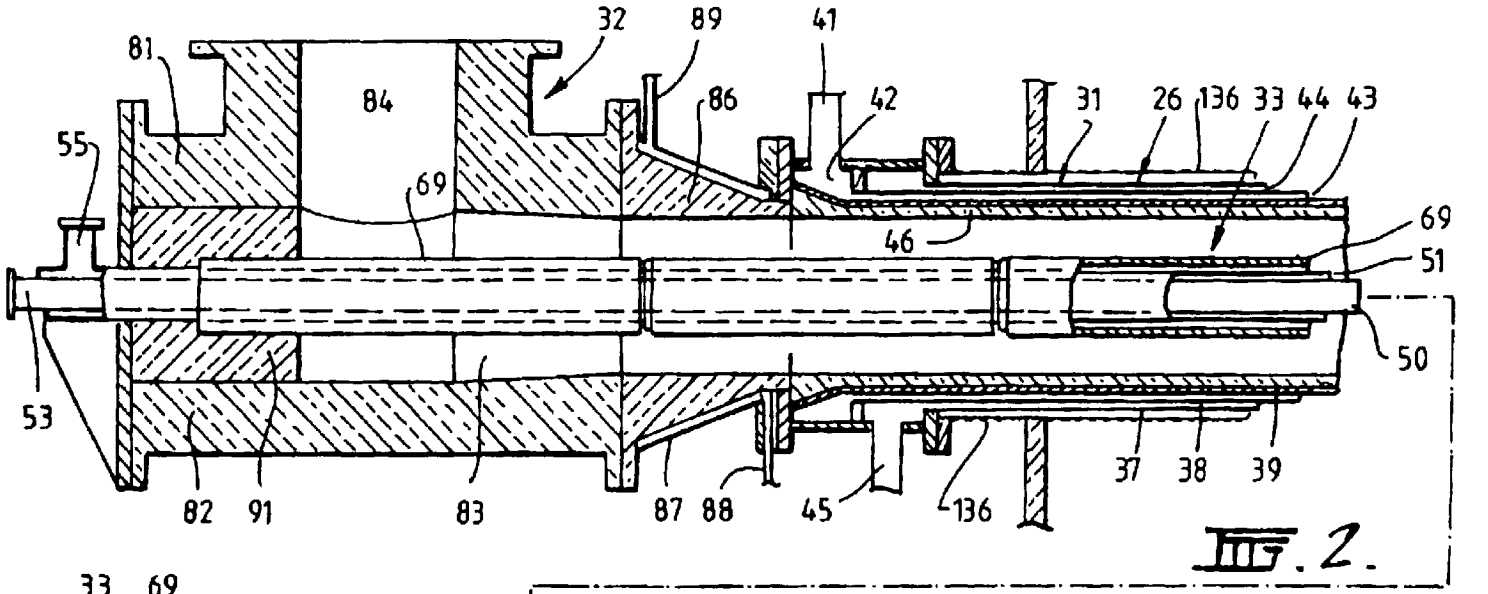
FIG. 2 is a longitudinal cross-section through one embodiment of the hot air injection lance.

The direct smelting apparatus shown in FIG. 1 includes a metallurgical vessel denoted generally as 11. The vessel 11 has a hearth that includes a base 12 and sides 13 formed from refractory bricks; side walls 14 which form a generally cylindrical barrel extending upwardly from the sides 13 of the hearth and which includes an upper barrel section 151 formed from water cooled panels and a lower barrel section 153 formed from water cooled panels having an inner lining of refractory bricks; a roof 17; an outlet 18 for off-gases; a forehearth 19 for discharging molten metal continuously; and a tap-hole 21 for discharging molten slag.

In use, the vessel contains a molten bath of iron and slag which, under quiescent conditions, includes a layer 22 of molten metal and a layer 23 of molten slag on the metal layer 22. The term "metal layer" is understood herein to mean a region of the bath that is predominantly metal. The term "slag layer" is understood herein to mean a region of the bath that is predominantly slag. The arrow marked by the numeral 24 indicates the position of the nominal quiescent surface of the metal layer 22 and the arrow marked by the numeral 25 indicates the position of the nominal quiescent surface of the slag layer 23 (ie of the molten bath). The term "quiescent surface" is understood to mean the surface when there is no injection of gas and solids into the vessel.

The vessel is fitted with a downwardly extending hot air injection lance 26 for delivering a hot air blast at a temperature in the range of 800–1400° C. into an upper region of the vessel and post-combusting reaction gases released from the molten bath. The lance 26 has an outer diameter D at a lower end of the lance. The lance 26 is located so that:

(i) a central axis of the lance 26 is at an angle of 20 to 90° relative to a horizontal axis so that the angle of injection of hot air is within this range;

(ii) the lance 26 extends into the vessel a distance that is at least the outer diameter D of the lower end of the lance; and (iii) the lower end of the lance 26 is at least 3 times the outer diameter D of the lower end of the lance above the quiescent surface 25 of the molten bath.

The vessel is also fitted with solids injection lances 27 (two shown) extending downwardly and inwardly through the side walls 14 and into the molten bath for injecting iron ore, solid carbonaceous material, and fluxes entrained in an oxygen-deficient carrier gas into the molten bath. The position of the lances 27 is selected so that their outlet ends 82 are above the quiescent surface of the metal layer 22. This position of the lances reduces the risk of damage through contact with molten metal and also makes it possible to cool the lances by forced internal water cooling without significant risk of water coming into contact with the molten metal in the vessel.

By way of context, a commercial vessel being constructed by the applicant's related company has a hearth diameter of 6 m and a hot air lance 26 that weighs approximately 60 tonnes with an outer diameter of 1.2 m and will extend approximately 10 m into the vessel.

The construction of one embodiment the hot air injection lance 26 is illustrated in FIGS. 2–10.

As shown in these figures lance 26 comprises an elongate duct 31 which receives hot gas through a gas inlet structure 32 and injects it into the upper region of vessel. The lance includes an elongate central tubular structure 33 which extends within the gas flow duct 31 from its rear end to its forward end. Adjacent the forward end of the duct, central structure 33 carries a series of four swirl imparting vanes 34 for imparting swirl to the gas flow exiting the duct. The forward end of central structure 33 has a domed nose 35 which projects forwardly beyond the tip 36 of duct 31 so that the forward end of the central body and the duct tip 36 co-act together to form an annular nozzle for divergent flow of gas from the duct with swirl imparted by the vanes 34. Vanes 34 are disposed in a four-start helical formation and are a sliding fit within the forward end of the duct.

The wall of the main part of duct 31 extending downstream from the gas inlet 32 is internally water cooled. This section of the duct is comprised of a series of three concentric steel tubes 37, 38, 39 extending to the forward end part of the duct where they are connected to the duct tip 36. The duct tip 36 is of hollow annular formation and it is internally water cooled by cooling water supplied and returned through passages in the wall of duct 31. Specifically, cooling water is supplied through an inlet 41 and annular inlet manifold 42 into an inner annular water flow passage 43 defined between the tubes 38, 39 of the duct through to the hollow interior of the duct tip 36 through circumferentially spaced openings in the tip. Water is returned from the tip through circumferentially spaced openings into an outer annular water return flow passage 44 defined between the tubes 37, 38 and backwardly to a water outlet 45 at the rear end of the water cooled section of duct 31.

The outer surface of the outermost metal tube 37 of duct 31 is machined with a regular pattern of rectangular projecting lands in the form of bosses 136 each having an undercut or dove tail cross-section so that the bosses are of outwardly diverging formation and serve as keying formations for solidification of slag on the outer surfaces of the lance 26. Solidification of slag on to the lance assists in minimising the temperatures of the metal components of the lance.

The water cooled section of duct 31 is internally lined with an internal refractory lining 46 that fits within the innermost metal tube 39 of the duct and extends through to the water cooled tip 36 of the duct. The inner periphery of duct tip 36 is generally flush with the inner surface of the refractory lining which defines the effective flow passage for gas through the duct. The forward end of the refractory lining has a slightly reduced diameter section 47 which receives the swirl vanes 34 with a snug sliding fit. Rearwardly from section 47 the refractory lining is of slightly greater diameter to enable the central structure 33 to be inserted downwardly through the duct on assembly of the lance until the swirl vanes 34 reach the forward end of the duct where they are guided into snug engagement with refractory section 47 by a tapered refractory land 48 which locates and guides the vanes into the refractory section 47.

The front end of central structure 33 which carries the swirl vanes 34 is internally water cooled by cooling water supplied forwardly through the central structure from the rear end to the forward end of the lance and then returned back along the central structure to the rear end of the lance. This enables a very strong flow of cooling water directly to the forward end of the central structure and to the domed nose 35 in particular which is subjected to very high heat flux in operation of the lance.

Central structure 33 comprises inner and outer concentric steel tubes 50, 51 formed by tube segments, disposed end to end and welded together. Inner tube 50 defines a central water flow passage 52 through which water flows forwardly through the central structure from a water inlet 53 at the rear end of the lance through to the front end nose 35 of the central structure and an annular water return passage 54 defined between the two tubes through which the cooling water returns from nose 35 back through the central structure to a water outlet 55 at the rear end of the lance.

The nose end 35 of central structure 33 comprises an inner copper body 61 fitted within an outer domed nose shell 62 also formed of copper. The inner copper piece 61 is formed with a central water flow passage 63 to receive water from the central passage 52 of structure 33 and direct it to the tip of the nose. Nose end 35 is formed with projecting ribs 64 which fit snugly within the nose shell 62 to define a single continuous cooling water flow passage 65 between the inner section 61 and the outer nose shell 62. As seen particularly in FIGS. 5 and 6 the ribs 64 are shaped so that the single continuous passage 65 extends as annular passage segments 66 interconnected by passage segments 67 sloping from one annular segment to the next. Thus passage 65 extends from the tip of the nose in a spiral which, although not of regular helical formation, does spiral around and back along the nose to exit at the rear end of the nose into the annular return passage formed between the tubes 51, 52 of central structure 33.

The forced flow of cooling water in a single coherent stream through spiral passage 65 extending around and back along the nose end 35 of central structure ensures efficient heat extraction and avoids the development of "hot spots" on the nose which could occur if the cooling water is allowed to divide into separate streams at the nose. In the illustrated arrangement the cooling water is constrained in a single stream from the time that it enters the nose end 35 to the time that it exits the nose end.

Inner structure 33 is provided with an external heat shield 69 to shield against heat transfer from the incoming hot gas flow in the duct 31 into the cooling water flowing within the central structure 33. If subjected to the very high temperatures and high gas flows required in a large scale smelting installation, a solid refractory shield may provide only short service. In the illustrated construction the shield 69 is formed of tubular sleeves of ceramic material marketed under the name UMCO. These sleeves are arranged end to end to form a continuous ceramic shield surrounding an air gap 70 between the shield and the outermost tube 51 of the central structure. In particular the shield may be made of tubular segments of UMCO 50 which contains by weight 0.05 to 0.12% carbon, 0.5 to 1% silicon, a maximum of 0.5% a maximum of 0.02% phosphorous, a maximum of 0.02% sulphur, 27 to 29% chromium, 48 to 52% cobalt and the balance essentially of iron. This material provides excellent heat shielding but it undergoes significant thermal expansion at high temperatures. To deal with this problem the individual tubular segments of the heat shield are formed and mounted as shown in FIGS. 7–10 to enable them to expand longitudinally independently of one another while maintaining a substantially continuous shield at all times. As illustrated in those figures the individual sleeves are mounted on location strips 71 and plate supports 72 fitted to the outer tube 51 of central structure 33, the rear end of each shield tube being stepped at 73 to fit over the plate support with an end gap 74 to enable independent longitudinal thermal expansion of each strip. Anti-rotation strips 75 may also be fitted to each sleeve to fit about raised spline strips 76 on tube 52 to prevent rotation of the shield sleeves.

Hot gas is delivered to duct 31 through the gas inlet section 32. The hot gas may be oxygen enriched air provided through heating stoves at a temperature of the order of 1200° C. This air must be delivered through refractory lined ducting and it will pick up refractory grit which can cause severe erosion problems if delivered at high speed directly into the main water cooled section of duct 31. Gas inlet 32 is designed to enable the duct to receive high volume hot air delivery with refractory particles while minimising damage of the water cooled section of the duct. Inlet 31 comprises a T-shaped body 81 moulded as a unit in a hard wearing refractory material and located within a thin walled outer metal shell 82. Body 81 defines a first tubular passage 83 aligned with the central passage of duct 31 and a second tubular passage 84 normal to passage 83 to receive the hot airflow delivered from stoves (not shown). Passage 83 is aligned with the gas flow passage of duct 31 and is connected to it through a central passage 85 in a refractory connecting piece 86 of inlet 32.

The hot air delivered to inlet 32 passes through tubular passage 84 of body 81 and impinges on the hard wearing refractory wall of the thick refractory body 82 which is resistant to erosion. The gas flow then changes direction to flow at right angles down through passage 83 of the T-shaped body 81 and the central passage 85 of transition piece 86 and into the main part of the duct. The wall of passage 83 may be tapered in the forward flow direction so as to accelerate the flow into the duct. It may for example be tapered to an included angle of the order of 7°. The transition refractory body 86 is tapered in thickness to match the thick wall of refractory body 81 at one end and the much thinner refractory lining 46 of the main section of duct 31. It is accordingly also water cooled through an annular cooling water jacket 87 through which cooling water is circulated through an inlet 88 and an outlet 89. The rear end of central structure 33 extends through the tubular passage 83 of gas inlet 32. It is located within a refractory liner plug 91 which closes the rear end of passage 83, the rear end of central structure 33 extending back from gas inlet 32 to the water flow inlet 53 and outlet 55.

The illustrated apparatus is capable of injecting high volumes of hot gas into the smelting vessel 11 at high temperature. The central structure 33 is capable of delivering large volumes of cooling water quickly and directly to the nose section of the central structure and the forced flow of that cooling water in an undivided cooling flow around the nose structure enables very efficient heat extraction from the front end of the central structure. The independent water flow to the tip of the duct also enables efficient heat extraction from the other high heat flux components of the lance. Delivery of the hot air flow into an inlet in which it impacts with a thick wall of a refractory chamber or passage before flowing downwardly into the duct enables high volumes of air contaminated with refractory grit to be handled without severe erosion of the refractory lining and heat shield in the main section of the lance.

The construction of another, although not the only other, embodiment of the hot air injection lance 26 is illustrated in FIGS. 11–19.

As shown in these figures, lance 26 comprises an elongate duct 31 through which to pass the flow of hot air, which may be oxygen enriched. Duct 31 is comprised of a series of four concentric steel tubes 32, 33, 34, 35 extending to a forward end part 36 of the duct where they are connected to a tip end piece 37. An elongate body part 38 is disposed centrally within the forward end part 36 of the duct and carries a series of four swirl imparting vanes 39. Central body part 38 is of elongate cylindrical formation with bull-nosed or domed forward and rear ends 41, 42. Vanes 39 are disposed in a four-start helical formation and are connected at their forward ends by radially outwardly extending vane ends 45 to the forward part of the duct.

Duct 31 is internally lined throughout most of its length by an internal refractory lining 43 which fits within the innermost metal tube 35 of the duct and extends through to the forward end parts 42 of the vanes, the vanes 39 fitting neatly within the refractory lining behind these forward end parts 42.

The tip end piece 37 of the duct has a hollow annular head or tip formation 44 which projects forwardly from the remainder of the duct so as to be generally flush with the inner surface of the refractory lining 43 which defines the effective flow passage for gas through the duct. The forward end of central body part 38 projects forwardly beyond this tip formation 44 so that the forward end of the body part and the tip formation co-act together to form an annular nozzle from which the hot air blast emerges in an annular diverging flow with a strong rotational or swirling motion imparted by the vanes 39.

In accordance with the present invention, duct tip formation 44, central body part 38 and vanes 39 are all internally water cooled with flows of cooling water provided by cooling water flow passage means denoted generally as 51 extending through the wall of the duct. Water flow passage means 51 comprises a water supply passage 52 defined by the annular space between the duct tubes 33, 34 to supply cooling water to the hollow interior 53 of duct tip formation 44 via circumferentially spaced openings 54 in tip end piece 37. Water is returned from the tip end piece through circumferentially spaced openings 55 into an annular water return flow passage 56 defined between the duct tubes 32 and 33 and also forming part of the water flow passage means 51. The hollow interior 53 of tip end piece 37 is thus continuously supplied with cooling water to act as an internal cooling passage. The cooling water for the lance tip is delivered into supply passage 52 through an water inlet 57 at the rear end of the lance and the returning water leaves the lance through an outlet 58 also at the rear end of the lance.

The annular space 59 between duct tubes 34 and 35 is divided by helically wound divider bars into eight separated helical passages 60 extending from the rear end of the duct through to the forward end part 36 of the duct. Four of these passages are supplied independently with water through four circumferentially spaced water inlets 62 to provide for independent water supplies for the cooling of vanes 39 and body part 38. Water inlets 62 communicate with a common water supply tube 80 via an annular supply manifold 90. The other four passages 60 serve as return flow passages which are connected to a common annular return manifold passage 63 and a single water outlet 64.

Vanes 39 are of hollow formation and the interiors are divided to form water inlet and outlet flow passages through which water flows to and from the central body part 38 which is also formed with water flow passages for internal water cooling. The forward end parts 45 of vanes 39 are connected to the forward end of innermost duct tube 35 about four water inlet slots 65 through which water flows from the four separately supplied water inlet flow passages into radially inwardly directed inlet passages 66 in the forward ends of the vanes. The cooling water then flows into the forward end of central body part 38.

Central body part 38 is comprised of forward and rear inner body parts 68, 69 housed within a casing 70 formed of a main cylindrical section 71 and domed front and rear end pieces 41, 42 which are hard faced to resist abrasion by refractory grit or other particulate material carried by the hot gas flow. A clearance space 74 between the inner parts 68, 69 and the outer casing of the central body part is subdivided into two sets of peripheral water flow passages 75, 76 by means of divider ribs 77, 78 formed on the outer peripheral surfaces of the inner body parts 68, 69. The forward set of peripheral water flow channels 75 are arranged to fan out from the front end of the central body part in the manner shown in FIG. 17 and backwardly around the body. A flow guide insert 81 is located centrally within the inner body part 68 to extend through the water flow passage 67 and to divide that passage into four circumferentially spaced water flow passages which independently receive the incoming flows of water through the water inlet passages 66 in the forward ends of the vanes, so maintaining four independent water inlet flows through to the front end of the central body part. These separate water flows communicate with the four front peripheral water flow channels 75 through which water flows back around the forward end of the central body part.

A baffle plate 82 divides the water inlet passages 66, 67 in the forward ends of the vanes and the central body part from water flow passages in the rear parts of the vanes and the central body part. The water flowing back through the forward peripheral channels 75 extends through slots 83 in this baffle located between the inlet passages 66 so as to flow back into a central passage 84 in the rear body part 69. This passage is also divided into four separate flow channels by means of a central flow guide 85 to continue the four separate water flows through to the rear end of the central body. The rear peripheral flow channels 76 are also arranged in a set of four in similar fashion to the by-passages 75 at the front end of the central body so as to receive the four separate water flows at the rear end of the body and to take them back around the periphery of the body back to four circumferentially spaced outlet slots 86 in the casing through which the water flows into return passage 87 in the vanes.

Figure 3:
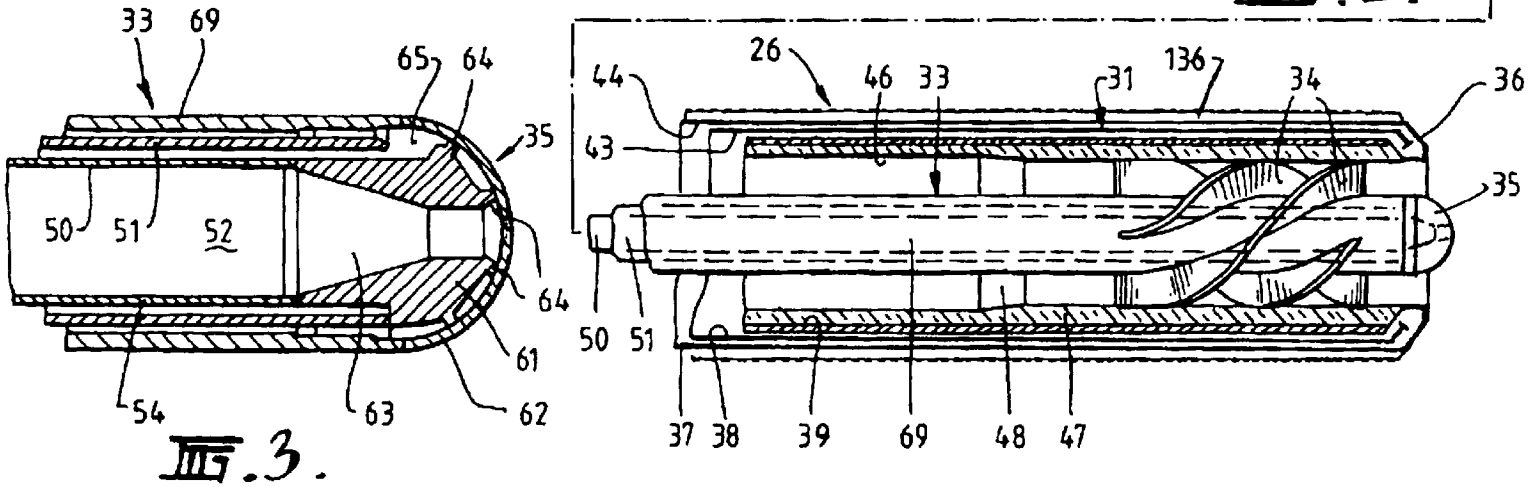
FIG. 3 is a longitudinal cross-section to an enlarged scale through a front part of a central structure of the lance.
Figure 4:
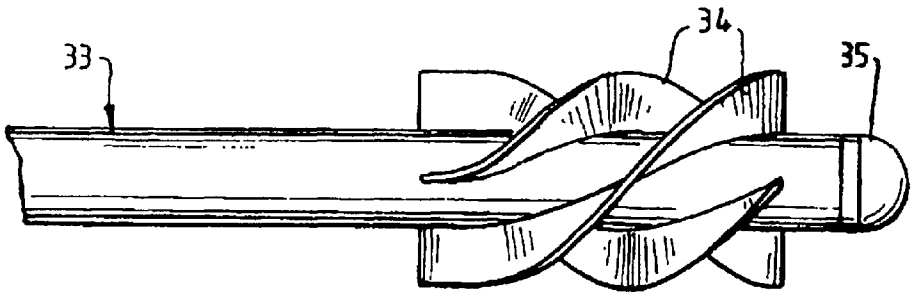
FIG. 4 further illustrates the forward end of the central structure.
Figure 11:
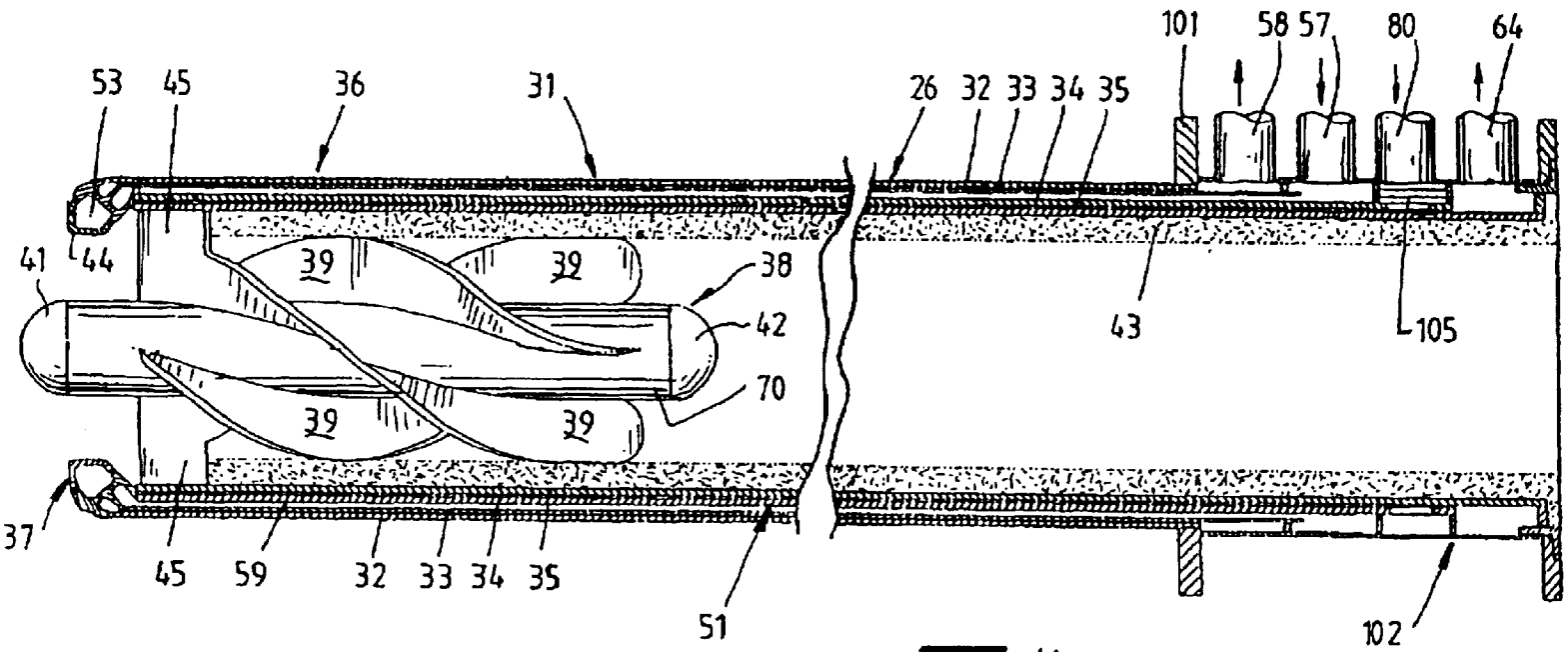
FIG. 11 is a longitudinal cross-section through another embodiment of the hot air injection lance.
Figure 5:
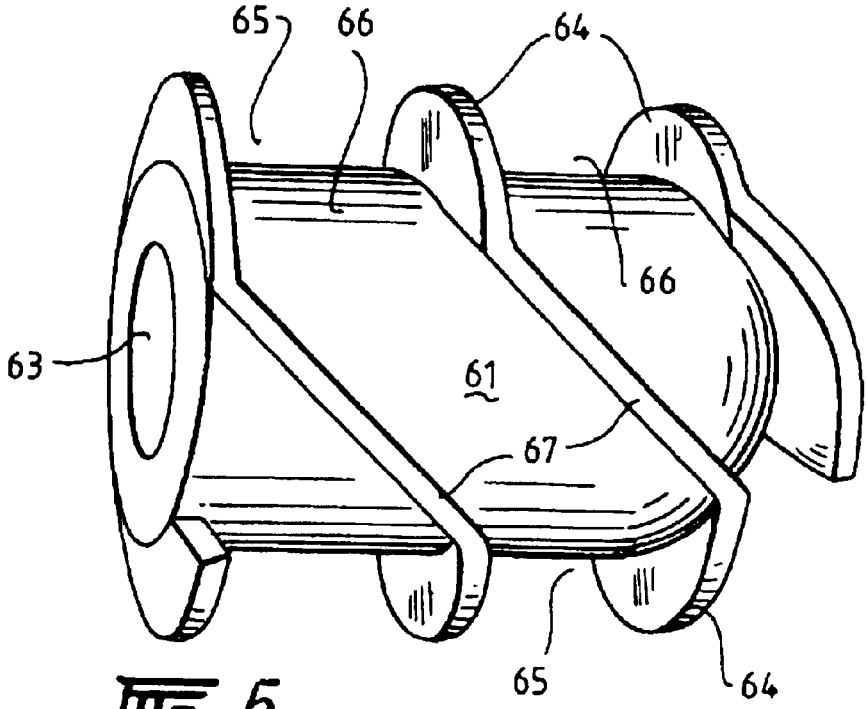
FIGS. 5 and 6 illustrate the construction of a forward nose end of the central structure.
Figure 6:
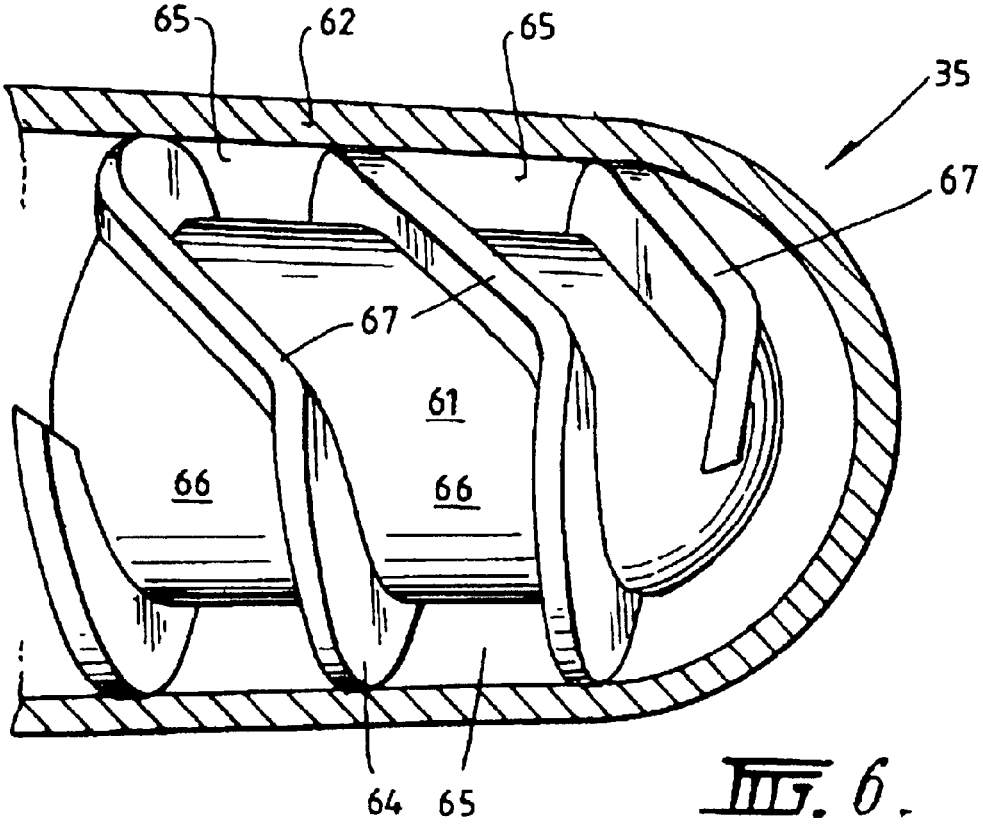
Figure 7:
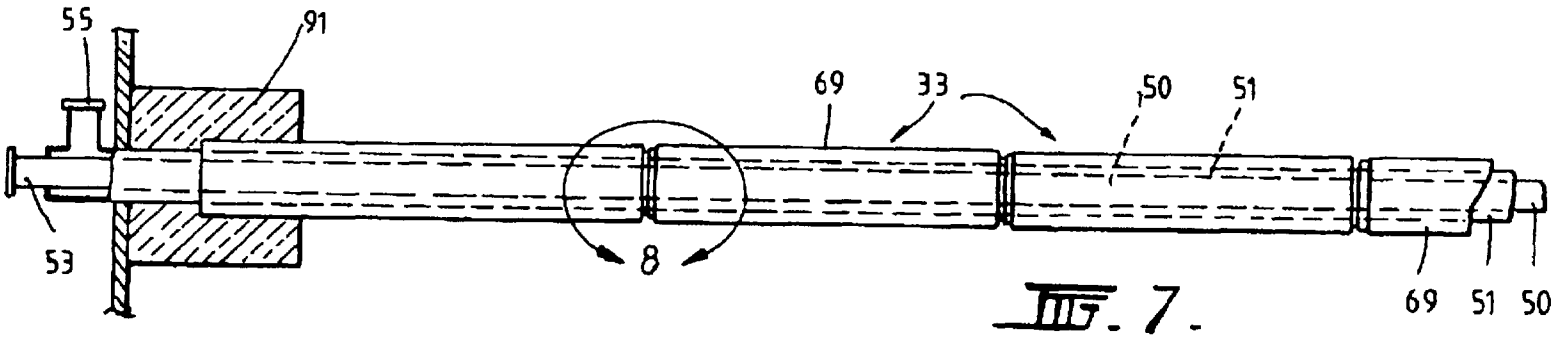
FIG. 7 is a longitudinal cross-section through the central structure.
Figure 10:
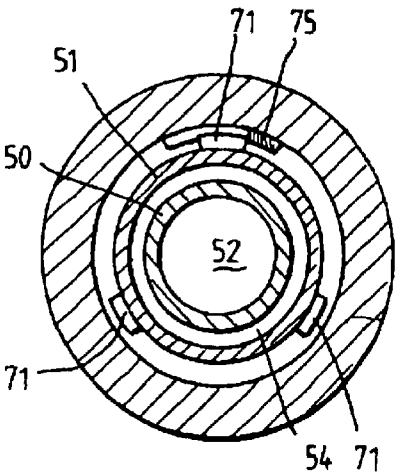
FIG. 10 is a cross-section on the line 10—10 in FIG. 8.
Figure 9:
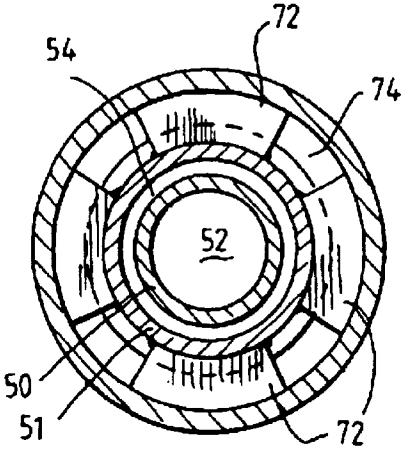
FIG. 9 is a cross-section on the line 9—9 in FIG. 8.
Figure 8:
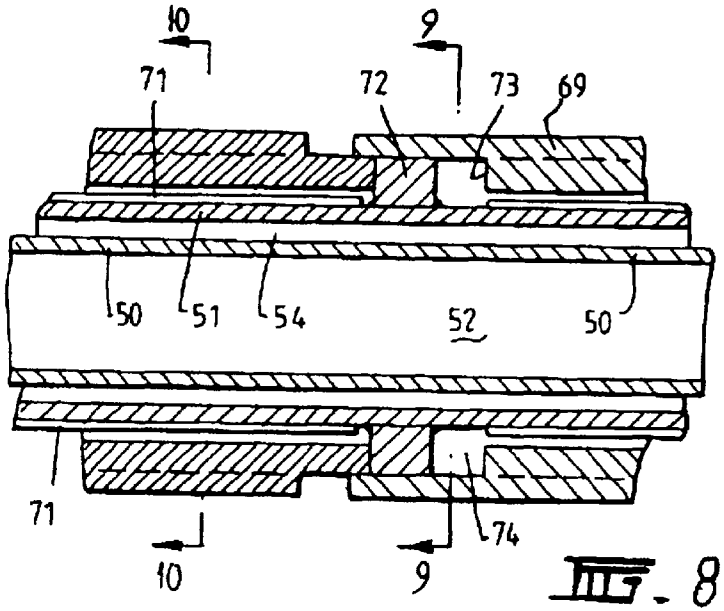
FIG. 8 shows a detail in the region 8 of FIG. 7.
Figure 12:
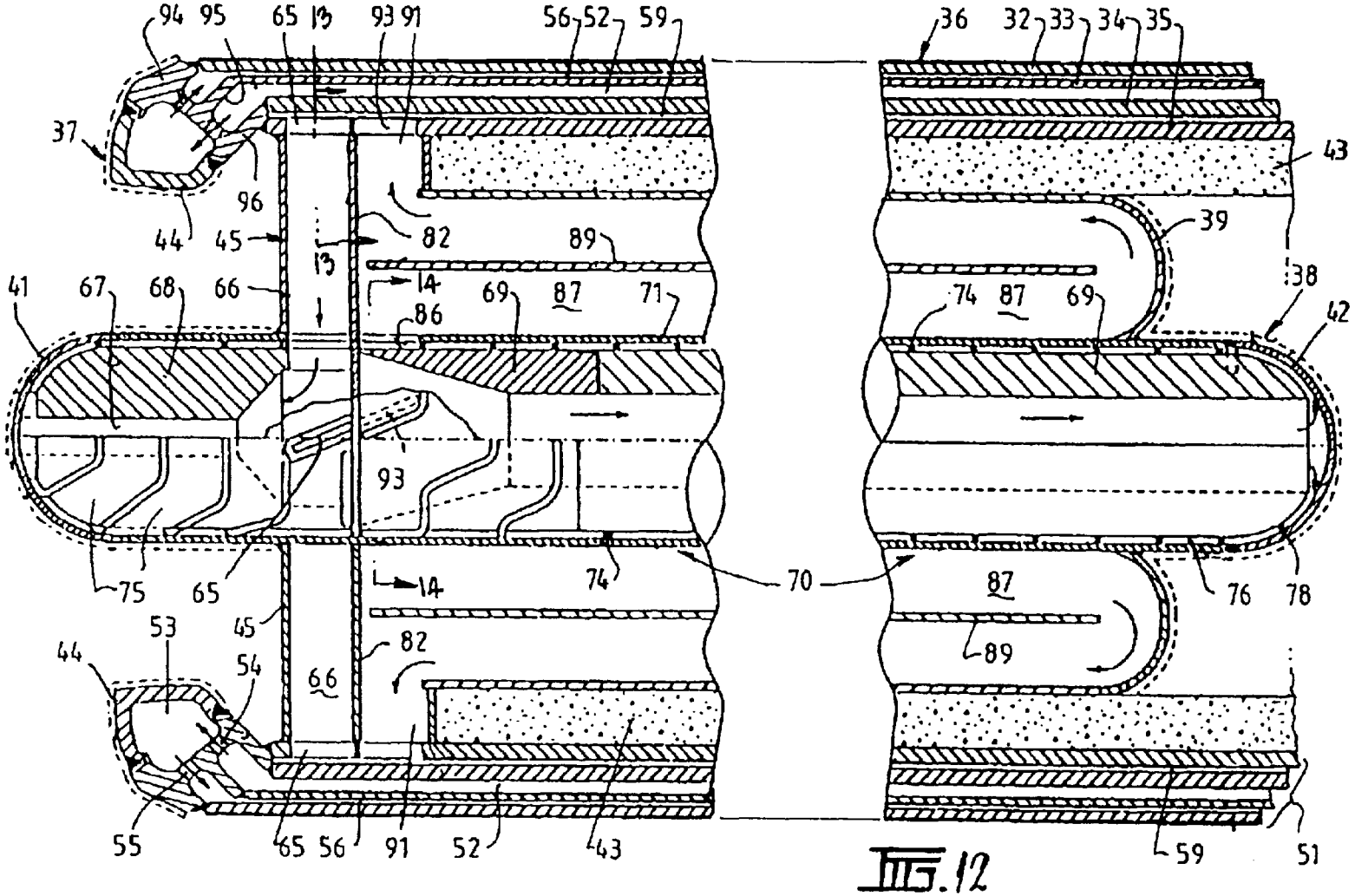
FIG. 12 is a longitudinal cross-section to an enlarged scale through a forward end part of the lance shown in FIG. 11.
Figure 13:
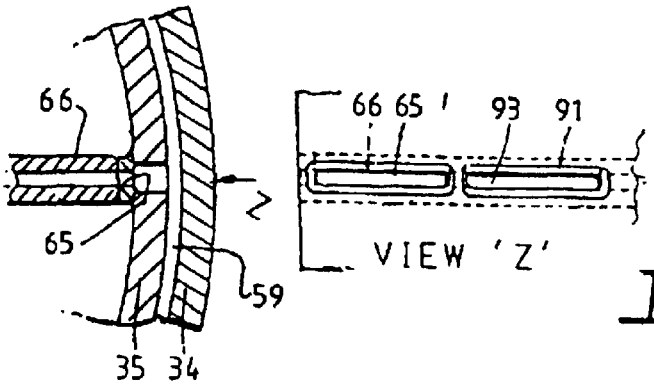
FIG. 13 is a cross-section on the line 13—13 in FIG. 12.
Figure 14:
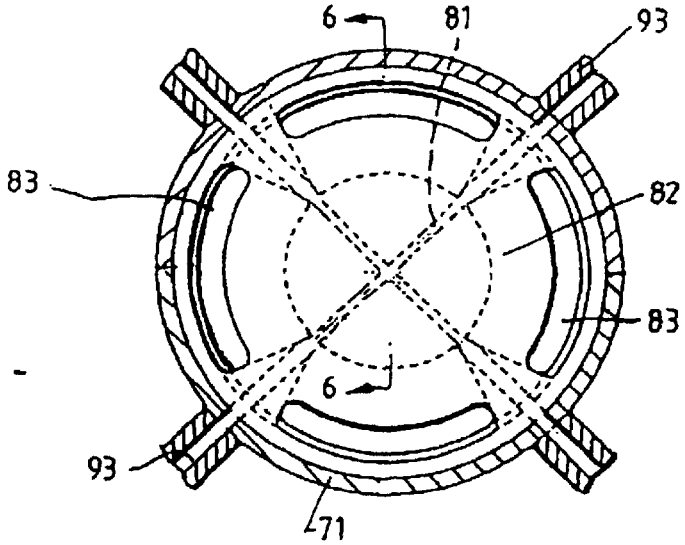
FIG. 14 is a cross-section on the line 14—14 in FIG. 12.
Figure 15:
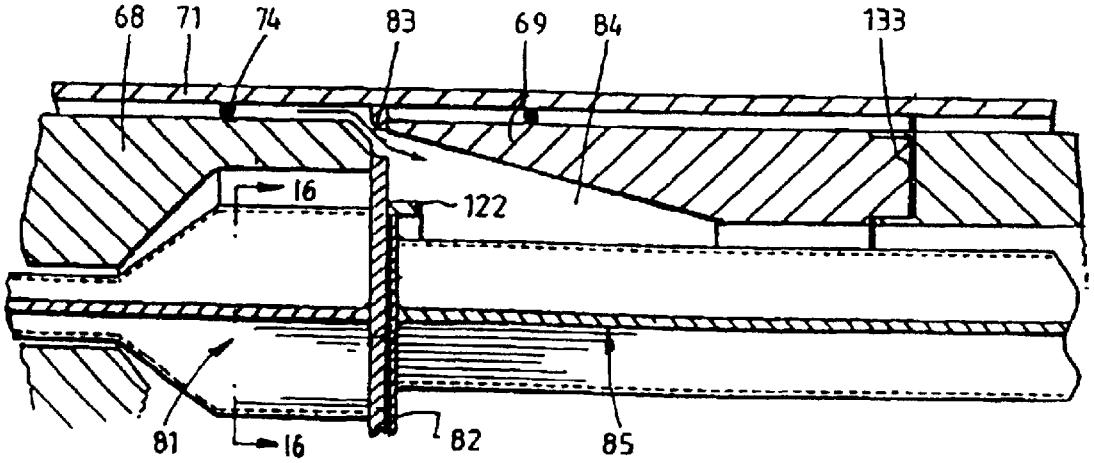
FIG. 15 is a cross-section on the line 15—15 in FIG. 14.
Figure 16:
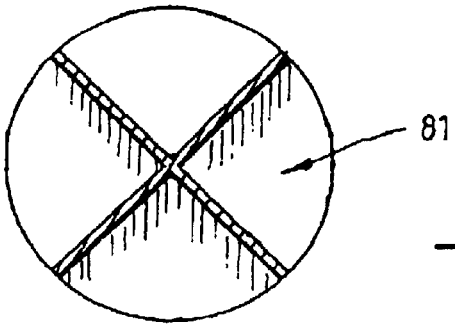
FIG. 16 is a cross-section on the line 16—16 in FIG. 15.
Figure 17:
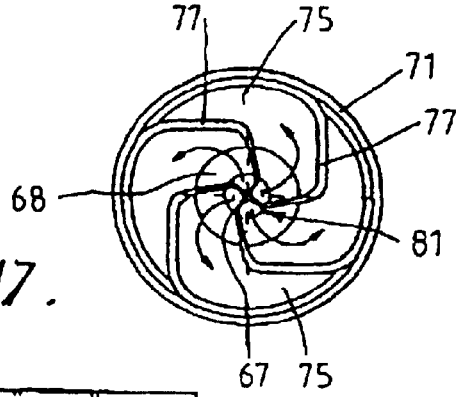
FIG. 17 illustrates water flow passages formed in a forward part of a central body disposed with the forward end of the lance shown in FIGS. 11–16.
Figure 18:
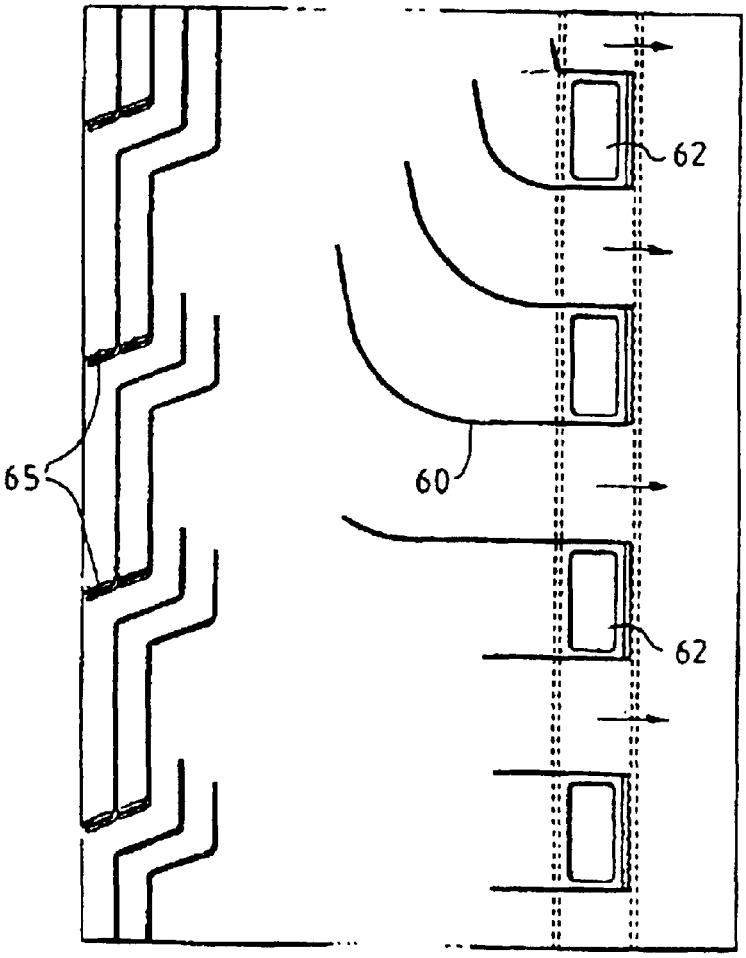
FIG. 18 is a development showing the arrangement of inlet and return water galleries for the central body part and four flow swirl vanes in the forward part of the lance shown in FIGS. 11–17.
Figure 19:
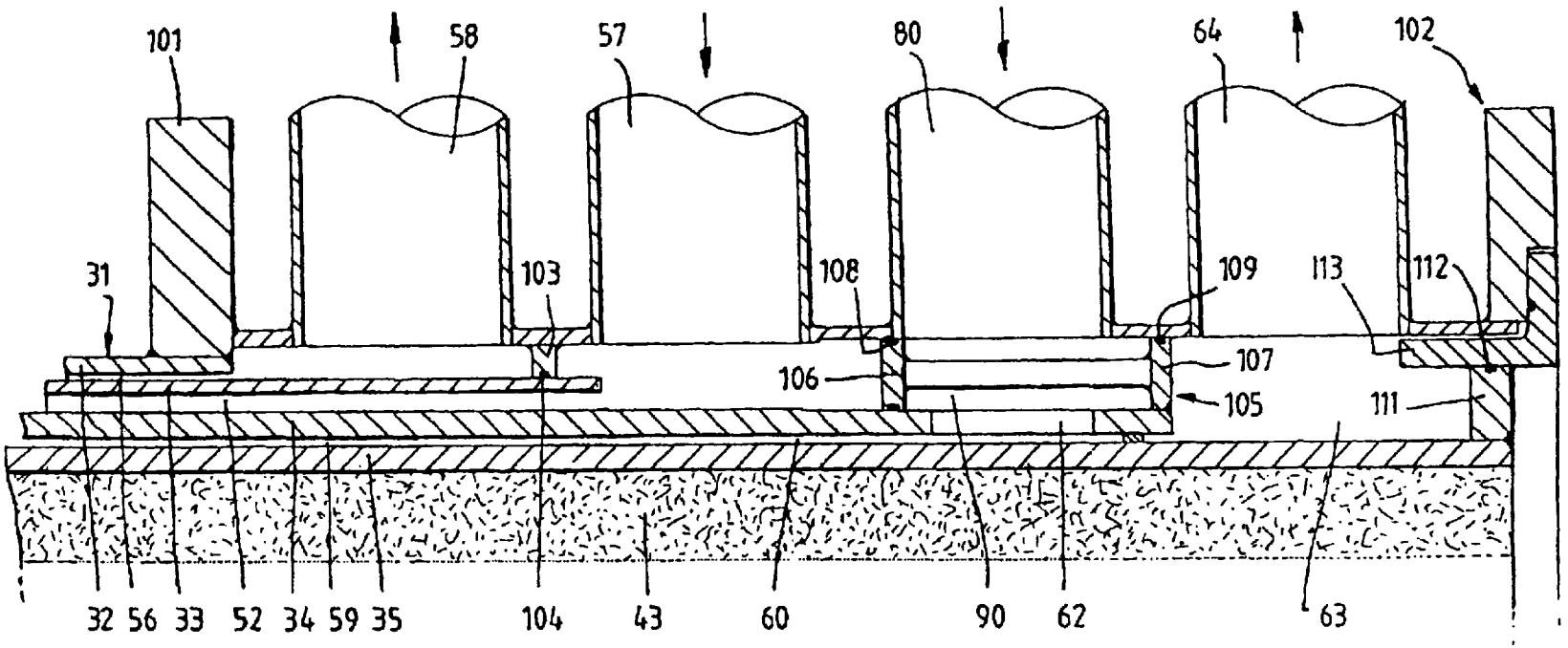
FIG. 19 is an enlarged cross-section through a rear part of the lance shown in FIGS. 11–18.

The hollow vanes are divided internally by longitudinal baffles 89 so that the cooling water passages extend from the inner forward ends of the vanes back to the rear ends of the vanes then outwardly and forwardly along the outer longitudinal ends of the vanes to radially extending water outlet passages 91 in the forward ends 42 of the vanes which communicate through outlet slots 93 with the four circumferentially spaced return passages extending back through the duct wall to the common outlet 64 at the rear end of the duct. Baffle 82 divides the inlet and outlet passages 66, 91 within the vanes and the water inlet and outlet flow slots 65, 93 for each vane are formed in the forward end of the inner duct tube 35 at an angle to the longitudinal direction to suit the helix angle of the vanes as seen in FIG. 3.

The forward ends of the four concentric duct tubes 32, 33, 34, 35 are welded to three flanges 94, 95, 96 of the tip end piece 37 so that they are firmly connected into a strong structure at the forward end of the lance. The rear ends of the duct tubes can move longitudinally with respect to one another to allow for differential thermal expansion during operation of the lance. As most clearly seen in FIG. 19, the rear end of duct tube 32 is provided with an outstanding flange 101 to which there is welded a continuous structure 102 which carries the various water inlets and outlets 57, 58, 80, 64. Structure 102 includes an internal annular flange 103 fitted with an O-ring seal 104 which serves as a sliding mounting for the rear end of duct tube 33, so allowing the duct tube 33 to expand and contract longitudinally independently of the outer duct tube 32. A structure 105 welded to the rear end of duct tube 34 includes annular flanges 106, 107 fitted with O-ring seals 108, 109 which provide a sliding mounting for the rear end of the duct tube 34 within the outer structure 102 fixed to the rear end of duct tube 32 so that duct tube 34 can also expand and contract independently of duct tube 32. The rear end of the inner most duct tube 35 is provided with an outstanding flange 111 fitted with an O-ring seal 112 which engages an annular ring 113 fitted to the outer structure 102 so as to also provide a sliding mounting for the innermost duct tube allowing for independent longitudinal expansion and contraction.

Provision is also made for thermal expansion of the flow guide vanes 39 and the inner body part 38. The vanes 39 are connected to the duct and to the inner body part only at their forward ends and in particular at the locations where there are water inlet and outlet flows at the inner and outer parts of the forward ends of the vanes. The main parts of the vanes simply fit between the refractory lining 43 of the duct and the casing of central body part 38 and are free to expand longitudinally. The water flow divider 85 within the rear section of the inner body part has a circular front end plate which slides within a machined surface of a tubular spigot 122 on baffle 82 so as to permit the forward and rear parts of the central body part to move apart under thermal expansion while maintaining sealing between the separated water flow passages. A thermal expansion joint 133 is provided to accommodate the thermal expansion between the forward and front ends of the central body part.

To further allow for thermal expansion, the vanes 39 may be shaped so as they do not extend radially outwardly between the casing of the central body part and the refractory lining of the duct when viewed in cross-section but such that they are slightly offset at an angle to the truly radial direction when the lance tubes and central body are in a cold condition. Subsequent expansion of the duct tubes during operation of the lance will allow the vanes to be drawn toward truly radial positions while maintaining proper contact with the duct lining and central body part while avoiding radial stresses on the vanes due to thermal expansion.

In operation of the illustrated hot air injection lance, independent cooling water flows are delivered to the four swirl vanes 39 so there can be no loss of cooling efficiency due to differential flow effects. The independent cooling water flows are also provided to the forward and rear ends of the central body part 38 so as to eliminate hot spots due to lack of water flow because of possible preferential flow effects. This is particularly critical for cooling of the forward end 41 of the central body part which is exposed to extremely high temperature conditions within the smelting vessel.

The duct tubes can expand and contract independently in the longitudinal direction under thermal expansion and contraction effects and the vanes and central body parts are also able to expand and contract without impairing the structural integrity of the lance or maintenance of the various independent flows of cooling water.

The illustrated lance is capable of operating under extreme temperature conditions within a direct smelting vessel in which molten iron is produced by the high smelt process. Typically the cooling water flow rate through the four swirl vanes and the central body part will be of the order of 90 $m^3$/Hr and the flow rate through the outer housing and the lance tip will be of the order of 400 $m^3$/Hr. The total flow rate may therefore be of the order of 490 $m^3$/Hr at a maximum operating pressure of the order of 1500 kPag.

Although the illustrated lances have been designed for injection of a hot air blast into a direct smelting vessel, it will be appreciated that similar lances may be used for injecting gases into any vessel in which high temperature conditions prevail, for example for the injection of oxygen, air or fuel gases into furnace vessels.

It is accordingly to be understood that the invention is in no way limited to the details of the illustrated construction and that many modifications and variations may be made to the invention as described.

What is claimed is:

1. A lance for injecting a pre-heated oxygen-containing gas into a vessel containing a bath of molten material, the lance including:

(a) an elongate gas flow duct extending from a rear to a forward end of the duct from which to discharge gas from the duct, the duct including; (i) inner and outer concentric carbon steel tubes which provide major structural support for the duct, (ii) cooling water supply and return passages extending through the duct wall from the rear end to the forward end of the duct for supply and return of cooling water to the forward end of the duct, (iii) an exterior surface that includes a mechanical device adapted to hold a layer of frozen slag on the duct;

(b) a gas inlet for introducing hot gas into the rear end of the duct;

(c) a tip joined to the concentric tubes at the forward end of the duct, (d) a protective lining formed from a refractory or other material that is capable of protecting the duct from exposure to gas flow at 800–1400° C. through the duct, the lining being a non-metallic material with heat insulating properties when compared to the steel tubes; and (e) a swirl imparting device located in the duct adapted to impart swirl to gas flow through the forward end of the duct.

2. The lance defined in claim 1 wherein the duct includes three or more concentric steel tubes extending to the forward end of the duct.

3. The lance defined in claim 1 wherein the gas inlet includes a refractory body defining a first tubular gas passage aligned with and extending directly to the rear end of the duct and a second tubular gas passage transverse to the first passage to receive hot gas and direct it to the first passage so that the hot gas and any particles entrained therein impinge on the refractory wall of the first passage, with the gas flow undergoing a change of direction in passing from the first passage to the second passage.

4. The lance defined in claim 1 wherein the mechanical device on the exterior surface of the duct includes projections that are shaped to interlock with and hold frozen slag on the duct.

5. The lance defined in claim 4 wherein the projections are lands with each land having an undercut or dovetail cross-section so that the lands are of outwardly diverging formation and serve as keying formations for solidification of slag.

6. The lance defined in claim 1 wherein the tip is of hollow annular construction and is formed from a copper-containing material.

7. The lance defined in claim 6 wherein the forward end of the duct is formed as a hollow annular tip formation and the duct includes tip cooling water supply and return passages for supply of cooling water forwardly along the duct into the duct tip and return of that cooling water back along the duct.

8. The lance defined in claim 1 further includes an elongate body disposed centrally within the forward end of the duct such that gas flowing through the forward end of the duct flows over and along the elongate central body.

9. The lance defined in claim 8 wherein a forward end of the elongate body and the tip co-act together and form an annular nozzle for flow of gas from the duct with swirl imparted by the swirl imparting device.

10. The lance defined in claim 8 wherein the swirl imparting device includes a plurality of flow directing vanes connected to the elongate body to impart swirl to gas flow through the forward end of the duct.

11. The lance defined in claim 10 wherein the elongate body is an elongate central tubular structure extending within the gas flow duct from its rear end to its forward end and the vanes are disposed about the central tubular structure adjacent the forward end of the duct to impart swirl to the gas flow to the forward end of the duct.

12. The lance defined in claim 11 wherein the central tubular structure includes a water cooling passage for flow of cooling water forwardly to its forward end.

13. The lance defined in claim 12 wherein the central tubular structure includes cooling water passages for flow of cooling water forwardly through the central structure from its rear end to its forward end and to internally cool the forward end and thence to return back through the central structure to its rear end.

14. The lance defined in claim 13 wherein the central tubular structure defines a central water flow passage for flow of water forwardly through that structure directly to the forward end of the central structure and an annular water flow passage disposed about the central passage for return flow of water from the forward end of the central structure back to the rear end of that structure.

15. The lance defined in claim 14 wherein the central tubular structure includes a central tube providing the central water flow passage and a further tube disposed around the central tube to define said annular water flow passage between the tubes.

16. The lance defined in claim 13 wherein the central tubular structure includes a heat insulating outer shield to retard heat transfer from gas in the gas flow duct into the cooling water passages in the central structure.

17. The lance defined in claim 16 wherein the heat insulating shield includes a plurality of tubular segments of heat insulating material disposed end to end to form the heat shield as a substantially continuous tube extending from the rear end to the forward end of the central tubular structure about an annular air gap disposed immediately within the heat shield.

18. The lance defined in claim 17 wherein the air gap is formed between the tubular heat shield and the further tube defining the outer wall of the annular water return flow passage.

19. The lance defined in claim 14 wherein the forward end of the central tubular structure includes a domed nose portion provided internally with a single spiral cooling water passage to receive water from the central water flow passage in the central tubular structure at the tip of the nose portion and direct that water in a single flow around and backwardly along the nose portion to cool the nose portion with a single coherent stream of cooling water.

20. The lance defined in claim 11, wherein the duct includes three or more concentric steel tubes extending to the forward end of the duct, and wherein the central tubular structure extends centrally through the first gas flow passage of the gas inlet and rearwardly beyond the gas inlet.

21. The lance defined in claim 20 wherein the rear end of the central tubular structure is located rearwardly of the gas inlet and the lance includes water couplings for the flow of cooling water to and from the central structure.

22. The lance defined in claim 10 wherein the flow directing vanes are disposed between the elongate central body and the duct to impart swirl to gas flow through the forward end of the duct.

23. The lance defined in claim 22 including:

(a) at least one internal cooling water passage within the tip communicating with cooling water supply and return passages of the duct so as to receive and return a flow of cooling water to internally cool the duct tip; and (b) cooling water flow passages within the vanes and the elongate central body and communicating with the cooling water supply and return passages in the forward end of the duct for flow of water from the supply passage inwardly through the vanes into the cooling passages of the elongate central body and from those passages outwardly through the vanes to the water return passage of the duct.

24. The lance defined in claim 23 wherein the cooling water supply and return passages of the duct include first supply and return passages communicating with the internal cooling water passage in the tip means and second supply and return passages communicating with the water flow passages in the vanes and the elongate central body.

25. The lance defined in claim 23 wherein the tip is formed as a hollow annular formation, the hollow formation defining an annular passage constituting said internal cooling water passage of the tip means.

26. The lance defined in claim 1 wherein the concentric carbon steel tubes of the duct define a series of annular spaces providing the cooling water supply and return passages.

27. The lance defined in claim 22 wherein the vanes are shaped to a multi-start helical formation.

28. The lance defined in claim 26 wherein the vanes are connected to the duct at multiple locations spaced circumferentially around the duct.

29. The lance defined in claim 27 wherein there are four vanes arranged in a four start helical formation and connected to the duct at four locations spaced at 90 degree intervals around the duct at the forward ends of the vanes.

30. The lance defined in claim 28 wherein the cooling water supply and return passages of the duct includes an appropriate number of separated water flow passages each to supply cooling water to one of the vanes.

31. The lance defined in claim 29 wherein the separated water flow passages are formed by dividers within an appropriate annular passage between tubes of the duct extending helically along the duct.

32. The lance defined in claim 1 wherein the forward ends of the concentric carbon steel tubes are connected at their forward ends to the tip.

33. The lance defined in claim 31 wherein the rear ends of the concentric carbon steel tubes are mounted to allow relative longitudinal movement between them so as to accommodate differential thermal expansion and contraction of the tubes.

34. An apparatus for producing ferrous metal from a ferrous feed material by a direct smelting process, which apparatus includes a vessel that can contain a bath of molten metal and molten slag and a gas continuous space above the molten bath, which vessel includes:

(a) a hearth formed of refractory material having a base and sides;

(b) side walls extending upwardly from the sides of the hearth, the side walls including water cooled panels;

(c) a means for supplying ferrous feed material and carbonaceous material into the vessel;

(d) a means for generating a gas flow in the molten bath which carries molten material upwardly above a nominal quiescent surface of the molten bath and forms a raised bath;

(e) at least one gas injection lance defined in any one of the preceding claims extending downwardly into the vessel for injecting oxygen-containing gas into the vessel at an angle of 20 to 90° relative to a horizontal axis at a velocity of 200–600 m/s and at a temperature of 800–1400° C., the lance being located so that:

(i) the lance extends into the vessel a distance that is at least the outer diameter of the forward end of the lance; and (ii) the forward end of the lance is at least 3 times the outer diameter of the forward end of the lance above a quiescent surface of the molten bath; and (f) a means for tapping molten metal and slag from the vessel.

35. The apparatus defined in claim 34 wherein the ferrous feed material and carbonaceous material supply means and the gas flow generating means includes a plurality of lances/tuyeres for injecting ferrous feed material and carbonaceous material with a carrier gas into the molten bath and generating the gas flow.

* * * * *